United States Patent [19]

McDonald

[11] Patent Number: 4,573,378

[45] Date of Patent: Mar. 4, 1986

[54] MAINTENANCE TOOL FOR INACCESSIBLE WHEEL VALVES

[76] Inventor: Gerald R. McDonald, 2629 View Mount Ave., Springfield, Oreg. 97477

[21] Appl. No.: 618,920

[22] Filed: Jun. 8, 1984

[51] Int. Cl.[4] ..... B25B 19/00

[52] U.S. Cl. ..... 81/463; 81/55; 81/119

[58] Field of Search ..... 81/463, 55, 56, 119, 81/120, 90 B, 90 D, 90 E, 90 F; 29/254

[56] References Cited

U.S. PATENT DOCUMENTS

| | | | |
|---|---|---|---|
| 2,641,052 | 6/1953 | Fennema et al. | 29/213 |
| 3,485,118 | 12/1969 | Maughan, Jr. | 81/125 |
| 3,491,837 | 1/1970 | Seccombe et al. | 81/56 |
| 3,584,511 | 6/1971 | Collins | 29/254 |
| 3,891,181 | 6/1975 | Sanders | 81/56 |
| 4,334,443 | 6/1982 | Pearson | 81/55 |
| 4,458,415 | 7/1984 | Maher et al. | 81/463 |

*Primary Examiner*—James L. Jones, Jr.

*Attorney, Agent, or Firm*—James D. Givnan, Jr.

[57] ABSTRACT

A hand tool for removing a wheel valve handle and tightening a valve packing nut. A wrench member detachably carries nut receiving sockets at its lower end. Arms at the lower end of a tubular member engage and retain the valve handle during handle removal and replacement. The tubular member is equipped with an impact slide member for facilitating handle removal. A spring member biases the arms and a valve handle thereon upwardly against a socket in place on the wrench member of the tool.

11 Claims, 4 Drawing Figures

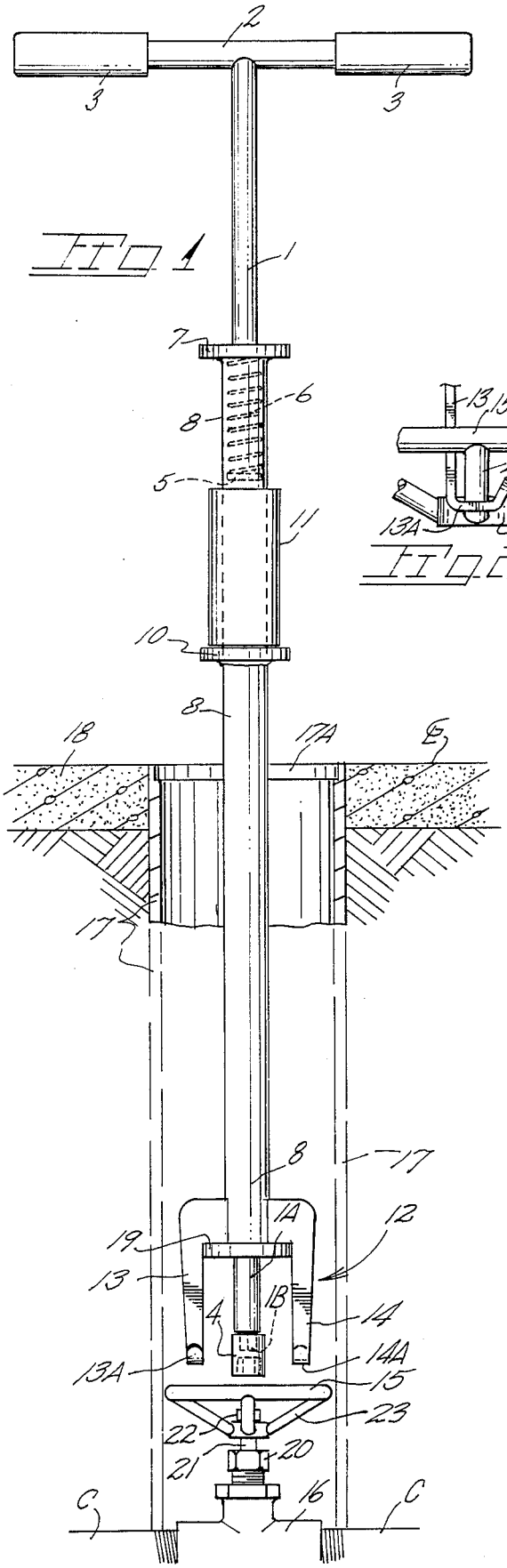
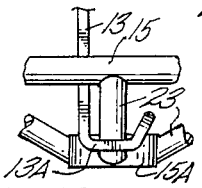
FIG. 2A
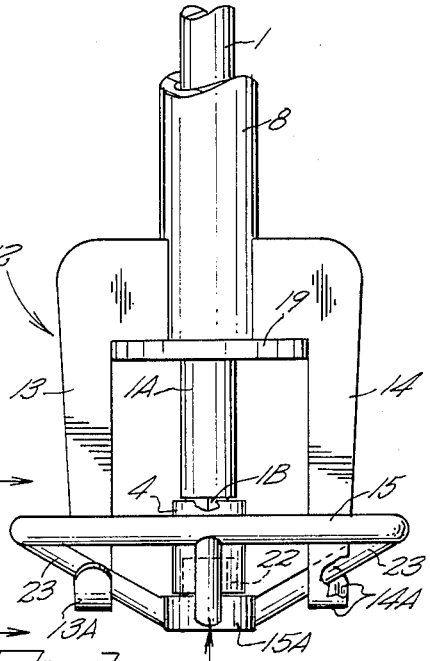
FIG. 2
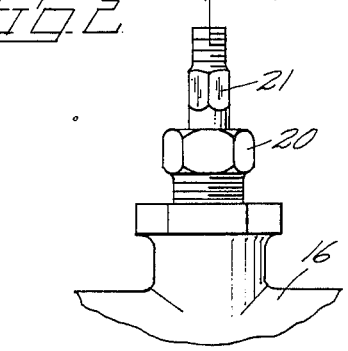
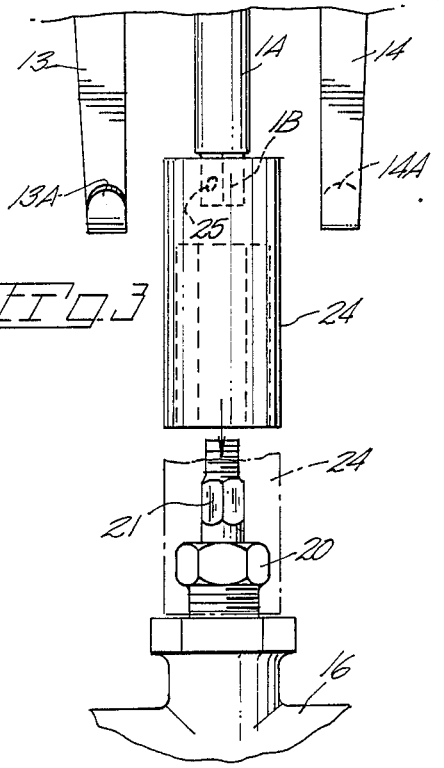
FIG. 3

MAINTENANCE TOOL FOR INACCESSIBLE WHEEL VALVES

BACKGROUND OF THE INVENTION

The present invention generally concerns manual tools for servicing valves which are at least somewhat inaccessible such as, for example, out of reach water or steam valves.

Municipal water systems utilize subterranean shut-off or wheel valves located at intervals along streets, roads, etc.,. Such valves are usually housed within cylindrical valve tiles which are of a diameter adequate only to receive a wrench to permit opening and closing of the valve. Accordingly, any valve repair or maintenance effort requires tile removal and excavation of surrounding earth all at considerable man-hour effort.

The most common problem encountered with such valves is leakage past the valve stem packing. In view of the high cost associated with the excavation of paved street or road surfaces and underlying earthen material, it is not uncommon for municipal water departments to permit such leakage to continue which in itself is costly over a period of time. Such leakage can eventually jeopardize paved street surfaces. Accordingly, some leakage past a valve stem packing is considered acceptable, albeit wasteful, over months and even years until such time as the flow is such as to fill the valve tile and reach the street or road surface.

Excavation efforts to achieve access to a buried valve are very costly from a man-hour and equipment standpoint. Disruption of the traffic flow and subsequent repaving also deter valve maintenance efforts.

To the extent the prior art is known, U.S. Pat. No. 4,334,443 discloses a tool for use on buried water meters and using a permanently attached socket member; U.S. Pat. No. 3,485,118 discloses a tool for expanding a stopper in a pipeline and using concentric tools for rotating a nut about a retained shaft; U.S. Pat. No. 2,641,052 discloses a tool for removing a stem and closure member from a buried valve; U.S. Pat. No. 3,651,556 discloses a water system tool for use in replacing system components.

SUMMARY OF THE PRESENT INVENTION

The present invention is embodied within a tool providing the capability of servicing an inaccessible valve.

The present tool includes a wrench member for acting on valve nut elements. Valve handle engaging means permit temporary tool attachment to the handle for the purpose of both handle removal and subsequent replacement. Provision is made for imparting upwardly directed forces to the handle engaging means for removing valve handles usually in place several years and offering considerable resistance to such removal. Upon handle removal the valve packing nut is accessible for servicing. The tool additionally serves to receive valve components to enable their reinstallation on the valve after tightening of a valve packing nut.

Important objectives include the provision of a tool for servicing below ground valves otherwise inaccessible for servicing without incurring the excavation of earthen material from about the valve; the provision of a tool for removal and replacement of valve components from a remote location; the provision of a tool capable of tightening a packing nut on a buried valve located several feet below ground level; the provision of a tool for both removal of a valve handle securing and handle nut, tightening of a packing nut and finally replacement of the handle and handle nut in a remote manner all on a valve located several feet below ground surface.

BRIEF DESCRIPTION OF THE DRAWING

In the accompanying drawing:

FIG. 1 is a side elevational view of the tool operatively disposed within a valve tile and superjacent a wheel valve;

FIG. 2 is a fragmentary side elevational view of the tool with a detached valve handle and retainer nut carried by the tool lower end;

FIG. 2A is a vertical elevational view taken along line 2A—2A of FIG. 2; and FIG. 3 is a view similar to FIG. 2 with a packing nut socket attached to the tool wrench member lower end.

DETAILED DESCRIPTION OF THE PREFERRED EMBODIMENTS

With continuing attention to the drawing wherein reference numerals indicate parts similarly hereinafter identified, the reference numeral 1 indicates a wrench member including an upright shaft equipped with a handle 2 provided with hand grips 3.

The shaft member of the wrench member terminates downwardly in an end segment 1A with a drive stud 1B formed at the shaft lower end. A nut receiving socket 4 is removably carried by drive stud 1B.

An annulus 5 formed on shaft 1 constitutes a limit stop for a helical spring 6 which bears at its upper end against a disc 7 carried by a tubular member 8 of the present maintenance tool.

Tubular member 8 is slidably disposed about shaft 1 and carries a second disc at 10 which supports impact slide member 11 adapted for grasping by the user and forceful upwarad impacting against end mount disc 7.

Valve handle engaging and retention means is indicated generally at 12 carried at one end of tubular member 8 and including valve handle engagement and retention means shown as arms 13 and 14 which depend from the end of the tubular member. The arms are horizontally spaced so as to enable the engagement of offset arm end segments 13A–14A with and retention of a hand wheel or handle 15 of a wheel valve 16. A plate 19 reinforces the arms. A handle hub is at 15A.

Typically, a water system wheel valve in a water system conduit will be located adjacent the bottom end of a valve tile 17 some three or four feet below ground level at GL. Commonly, the ground surface will be a paved surface of a street or roadway as at 18. Such valve tiles may be approximately six inches in diameter and include a shouldered rim 17A within which sits a cover plate, not shown.

Wheel valves as at 16 are located at intervals along a water supply conduit at C may vary in design, but generically include a packing nut 20 which biases packing tightly about a valve stem 21.

In one use of the present maintenance tool the tool is positioned as shown in FIG. 1 with further downward movement causing socket 4 to fit about a handle retaining nut 22. Still further downward positioning of arms 13 and 14 causes same to engage handle spokes as at 23 of the valve handles to prevent handle rotation. Rotation of socket 4 by manual rotation of shaft 1 causes nut 22 to be backed off valve stem 21 whereupon the arm ends 13A–14A, each disposed beneath a spoke 23, may impart lifting to the valve handle with impact forces if necessary as earlier noted. Partially compressed spring 6 urges tubular member 8 upwardly along with its attached arms 13 and 14 to bias the handle 15 upwardly which, in turn, retains nut element 22 within socket 4 per FIG. 2.

Upon the tool being removed from the valve tile 17, valve handle 15 is disengaged from the arm end segments 13A–14A and socket 4 detached from drive stud 1B. As shown in FIG. 3, a packing nut or second socket 24 is then attached to stud 1B and the tool reintroduced into valve tile 17 with socket 24 engaging packing nut 20. Accordingly, adjustment of packing nut 20 may then be accomplished by rotation of shaft member 1.

Reinstallation of handle 15 and handle nut 22 is accomplished by the reattachment of socket 4 with the handle retainer nut therein and handle 15 in place with its spokes carried by arm ends 13A–14A. Upon reintroduction of the tool and handle 15 back into the valve tile, the handle is fitted over valve stem 21 with subsequent rotation of shaft 1 causing handle retainer nut 22 to be tightened in place on valve stem 21. Tool separation from handle 15 is accomplished by slight downward repositioning of tubular member 8 and subsequent arcuate rotation thereof for detachment of the offset arm ends 13A–14A from the handle spokes.

Impact sleeve 11 permits the imparting of forces against handle 15 in those instances where the handle is held on the valve spindle in a snug or rusted manner. Drive stud 1B may be equipped with a detent at 25 to retain the sockets 4 and 24 in place thereon.

It is to be understood that the arms 13 and 14 may be otherwise configured to engage certain valve handle shapes and sizes and that socket 4 is preferably removably mounted to the end of shaft segment 1A though not restrictively so.

While I have shown but one embodiment of the invention it will be apparent to those skilled in the art that the invention may be embodied still otherwise without departing from the spirit and scope of the invention.

Having thus described the invention, what is desired to be secured in a Letters Patent is:

I claim:

1. A tool for servicing remotely disposed handle equipped valves having a packing nut, said tool comprising, an elongate wrench member including a shaft adapted at its lower end for engagement with a valve nut securing the valve handle, and a tubular member movably mounted on said wrench member and including valve handle engagement and retention means at one end for inserted engagement with the valve handle, said tubular member including an impact surface against which upwardly directed forces may be imparted during handle removal from the valve.

2. The tool claimed in claim 1 additionally including resilient means interposed between said wrench member and said tubular member for biasing said tubular member and a valve handle carried by said handle engagement and retention means toward said lower end of the elongate wrench member.

3. The tool claimed in claim 1 additionally including an impact slide on said tubular member for forceful contact with said impact surface.

4. The tool claimed in claim 1 wherein the lower end of said shaft of the wrench member is embodied in a drive stud on which may be alternatively mounted a socket member engageable with a nut securing the valve handle in place and a second socket member engageable with the valve packing nut for tightening same.

5. The tool claimed in claim 4 wherein said handle engagement and retention means are arms depending from said tubular member, each of said arms terminating in an offset end segment adapted for lifting engagement with a handle portion.

6. A tool for servicing in a remote manner handle equipped valves located below ground level and of the type having both a handle secured by a nut and a packing nut located adjacent the valve handle, said tool comprising, an elongate wrench member adapted at one end for engagement with a valve nut, a tubular member slidably disposed on said elongate wrench member and including end mounted valve handle engagement and retention means, and resilient means urging said tubular member in an axial direction to bias a valve handle temporarily in engagement with said handle engagement and retention means toward said one end of said wrench member whereby the valve handle may be removed from the valve being serviced.

7. The tool claimed in claim 6 wherein said wrench member includes a drive stud at said one end for the reception of differently sized socket members for nut engagement.

8. The tool claimed in claim 6 wherein said tubular member includes an impact member for facilitating handle separation from the valve.

9. The tool claimed in claim 8 wherein said impact member is a slidably mounted component in place on said tubular member.

10. The tool claimed in claim 6 wherein said valve handle engagement and retention means comprises arms projecting beyond one end of said tubular member, each of said arms adapted for inserted biased engagement with the valve handle.

11. The tool claimed in claim 10 wherein each of said arms includes an offset end segment angularly disposed to the remainder of the arm for the purpose of retentive engagement with a spoke of the valve handle.

* * * * *